US006241032B1

(12) United States Patent
Falgout, Sr.

(10) Patent No.: US 6,241,032 B1
(45) Date of Patent: Jun. 5, 2001

(54) ONE-WAY DRILL STRING CLUTCH

(76) Inventor: Thomas E. Falgout, Sr., 110 Charles Read St., Lafayette, LA (US) 70503

( * ) Notice: Subject to any disclaimer, the term of this patent is extended or adjusted under 35 U.S.C. 154(b) by 0 days.

(21) Appl. No.: 09/390,742

(22) Filed: Sep. 7, 1999

(51) Int. Cl.[7] ..... E21B 23/00

(52) U.S. Cl. ..... 175/318; 166/237; 192/30 W; 192/46; 192/69.81

(58) Field of Search ..... 175/318; 166/237; 192/30 W, 46, 69.8, 69.81, 69.82, 69.83, 108

(56) References Cited

U.S. PATENT DOCUMENTS 3,908,453 * 9/1975 Jeter ..... 73/151
4,391,328 * 7/1983 Aumann ..... 175/318
4,632,193 12/1986 Geczy .
4,848,531 * 7/1989 Gray et al. ..... 192/30 W
5,673,764 * 10/1997 Falgout, Sr. ..... 175/101
5,775,444 * 7/1998 Falgout, Sr. ..... 175/322
5,918,690 7/1999 Halley .
6,082,457 * 7/2000 Best et al. ..... 166/301

* cited by examiner

*Primary Examiner*—William Neuder
(74) *Attorney, Agent, or Firm*—John D. Jeter

(57) ABSTRACT

The apparatus has a housing arranged to function as a length of drill string, including a fluid tight fluid conducting bore, with means at each end for connecting to a continuing drill string. The housing has two principal portions bearingly connected for rotation and axial constraint. A spring loaded one way clutch connects the two portions such that torque can be conducted therethrough in only one rotational direction. The clutch has one, spring loaded, axially moving element to actuate the clutch unless locked by optional provisions. The axial movement, optionally, actuates a valve in the fluid conducting bore to create a pressure drop in the fluid stream when the clutch is disengaged to provide a pressure signal that can be detected at the surface to indicate that the clutch is disengaged.

16 Claims, 2 Drawing Sheets

ONE-WAY DRILL STRING CLUTCH

This invention pertains to a one-way clutch apparatus for use on drill strings to prevent rotational backlash of the drill string, from suddenly released torque loads, from unscrewing the bottom hole assembly. The clutch transmits torque in the forward, or drilling, direction but free wheels in the reverse direction. The apparatus can be used above or below a Measurement While Drilling (MWD) system, or anywhere below the Kelly.

BACKGROUND

During rotary drilling, the torque applied to the drill head can wind up the drill string several turns, distributed over the drill string length. This is in turns that the drill head lags the rotary table input at the surface. If the drill head is suddenly lifted off bottom, the torque at the drill head approaches zero and the drill head races forward as the string rotationally unwinds. The lower end of the unwinding drill string can overshoot the neutral position and cause torque in the opposite direction. The reversal from the overrun position tends to unscrew the bottom hole assembly from the drill string. The tendency to unscrew connections can take place anywhere along the drill string. That sequence of events can be prevented under most normal circumstances by an experienced driller, by avoiding sudden removal of bit load while the string is delivering torque to the drill head. Sudden release of bit load, due to unexpected circumstances, sometimes happens. The lower end assembly unscrewed from the drill string and loose down hole is a classic drilling problem that is expensive to correct.

SUMMARY OF INVENTION

The apparatus is a one-way clutch in a housing which is part of a continuing drill string. The housing has to selectively permit relative rotation between upper and lower parts of the housing and is rugged enough for drilling activity while retaining fluid tightness to confine fluid moving down the drill string bore. The bearings rotationally connecting the two major housing parts seldom rotate and are situated for column rigidity of the housing. A clutch member, preferably with teeth for engagement, is biased by weight, spring, or piston loads for axial movement in one part of the housing to urge it into engagement with matching clutch teeth in the mating portion of the housing. The movable clutch member is preferably spline connected to its respective portion of the housing for torque transmission when the teeth are engaged. Splines are easily managed in manufacture and maintenance activity but there are many means for rotationally connecting a clutch element, yet allow limited axial movement for clutch action.

A fluid conducting bore extends through the housing, which has connector arrangements at the ends for connection to the continuing drill string.

An optional signal generator in the fluid conducting bore produces a pressure change in the flowing drilling fluid to indicate, by a drilling fluid pressure increase, when the clutch is disengaged. The pressure increase is detectable at the surface, in the drilling fluid circuit, to alert the driller of the down hole condition. The signal pressure drops back to normal when the clutch is again engaged.

The preferred clutch is a saw toothed arrangement that can, in one option, engage in only one position of relative rotation between the upper and lower portions of the apparatus. This option is used when the apparatus is situated below a MWD system.

For use in unusual circumstance, when torque may need to be transmitted down the drill string in both rotational directions, optional provisions permit the apparatus to be locked rotationally by a spear dropped down the drill string bore. Such spears are well established in the well drilling art and are normally recoverable by wire line from the surface. A spear lowered through the drill string to a receiving device down hole to accomplish a planned effect is in the art of downlink command communication signal activity. The spear is usually recoverable by wire line.

It is an object of the invention to provide a drill string clutch that will prevent the drill string from applying a rotational force to the drill string that can unscrew the drill string tool joints.

It is another object of the invention to provide a signal in the drilling fluid stream that will alert a driller at the surface that the clutch is disengaged down hole.

It is another object of the invention to provide a clutch that will re-engage only in one relative rotational position between portions of the housing to orient the upper portion of the drill string with the lower portion of the drill string.

It is still another object of the invention to provide means to rotationally lock the apparatus so that the clutch will stay engaged when torque is applied in either direction.

These and other objects, advantages, and features of this invention will be apparent to those skilled in the art from a consideration of this specification, including the attached claims and appended drawings.

BRIEF DESCRIPTION OF DRAWINGS

In the drawings wherein like features have similar captions.

DETAILED DESCRIPTION OF DRAWINGS

Figure 1:
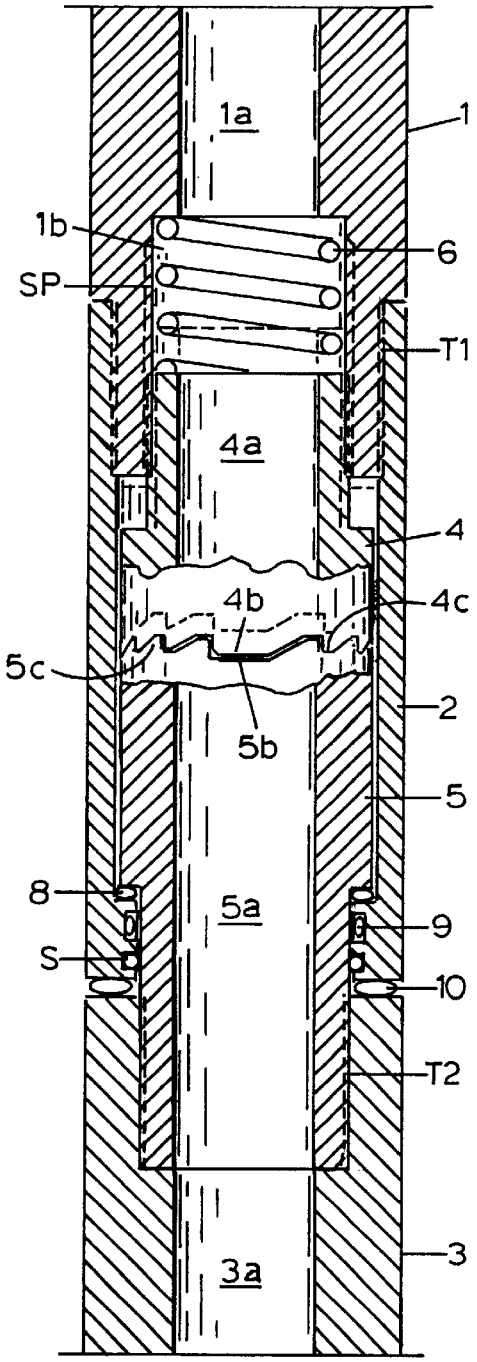
FIG. 1 is a side elevation, mostly cut away, of the preferred embodiment of the invention.
Figure 2:
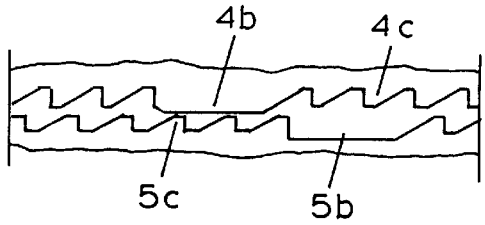
FIG. 2 is a surface development of the preferred clutch teeth arrangement of a portion of FIG. 1.

In the drawings, FIG. 1 is arranged to function as a length element of a drill string. The usual tool joints required at each end of the housing for attachment of the housing to continuing drill string elements are not shown. Upper body 1 is attached by threads T1 to central body 2. Lower body 3 is threadedly attached to lower drive member 5 by threads T2. Lower drive member 5 is axially supported in central body 2 by thrust bearing 8. Compression forces between lower body 3 and central body 2 are carried by thrust bearing 10. The flow bore for drilling fluid comprises bores 1*a*, 4*a*, 5*a* and 3*a*. Seal S is the closure which provides fluid tightness of the flow bore to permit rotation of central body 2 relative to lower body 3. Threads T1 and T2 are fluid tight.

Clutch element 4 can move axially in the bore of central body 2 and is rotationally secured to upper body 1 by way of mating splines SP in bore 1*b* and on the cooperating extension of clutch element 4. Spring 6 in bore 1*b* urges clutch element 4 downward to cause teeth 4*b* and 4*c* to engage teeth 5*b* and 5*c* on drive member 5. The spring supplements the piston effect pushing the clutch element downward when fluid flows down the pipe string. Rotational effort is then conducted between upper body 1 and lower body 3, and attached continuing drill string components. Typical jaw clutches have a peripherally distributed array of teeth separated by slots, or recesses, with each tooth array received within the slot array of the opposing, mating, clutch member.

The clutch teeth are arranged with saw tooth shapes to conduct torque in the drilling direction only. When torque is applied in the opposite direction, the teeth are cammed apart and clutch element 4 rises, compressing spring 6, to clear the teeth. Upper body 1 can then rotate backwards relative to the lower body 3, centralized by bearing 9 and, axially confined by either bearing 8 or 10.

The bearings shown can be considered symbolic, the practical bearings being more complex and depending upon tool size for selection. The seal can be considered symbolic. The practical seals are defined by fluids, temperatures expected, and other considerations.

If the apparatus is to be used below Measurement While Drilling (MWD) units it should re-engage the clutch such that the rotational relationship between lower body 3 and upper body 1 is reestablished. The mating clutch teeth are arranged with one tooth and one receiving recess peripherally wider than other teeth and recesses. Once the clutch is disengaged, the wide tooth will ride over all other recesses until it comes to the wide recess which it engages. Once the wide tooth falls into the receiving recess, other teeth engage to carry torque. To reduce tooth crown wear, narrow teeth are cut to clear opposing teeth crowns, with the wide tooth carrying the spring load that urges engagement. The wide tooth is shaped such that there is no leading edge that engages the abutment on the receiving recess. A bevel on the leading edge functions as a skid to reduce impact loads on teeth over which it rides. The skid dimension has little effect on clutch holding ability once the clutch is engaged. Clutch teeth can be made radially dissimilar for selective mating of teeth for orientation, if preferred. The principle is the same as for peripherally dissimilar teeth. A single tooth, and cooperating recess, are sufficient to carry out the clutch function, and many forms of such arrangements are well within the understanding of those skilled in the art of such machine construction.

Figure 3:
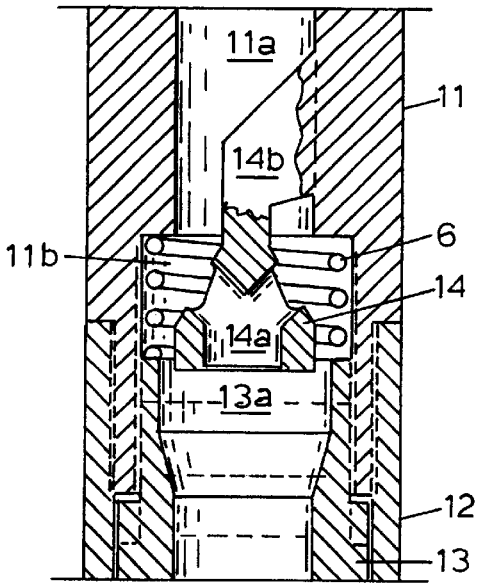
FIG. 3 is a side elevation of a portion of an alternate embodiment, mostly cut away, of the apparatus that differs from the embodiment of FIG. 1.

The operation of the apparatus is automatic and will function quite well without controlling input from a driller on the surface but drillers often want to know if the apparatus has re-engaged. A pressure signal generator is shown in FIG. 3. Element 4 of FIG. 1 is changed to that form captioned 13, with bore 13*a* somewhat enlarged. Poppet 14 is suspended in opening 11*b*, somewhat above bore 13*a* until element 13 is moved upward by the clutch teeth as previously described herein. When element 13 moves upward, the poppet is in a flow resisting position and causes a pressure increase in drilling fluid flowing down the drill string and through the apparatus. Orifice 14*a* produces a jet which reduces the pressure in the vicinity of the top of element 13 to avoid overload on that element that could result from the piston effect. Poppet 14 is mounted, by way of attachment 14*b* on upper body 11, in bore 11*a*. Central body 12 may be identical to body 2. There are several ways to actuate a valve in response to movement of the clutch element. The simplest approach is shown.

Figure 4:
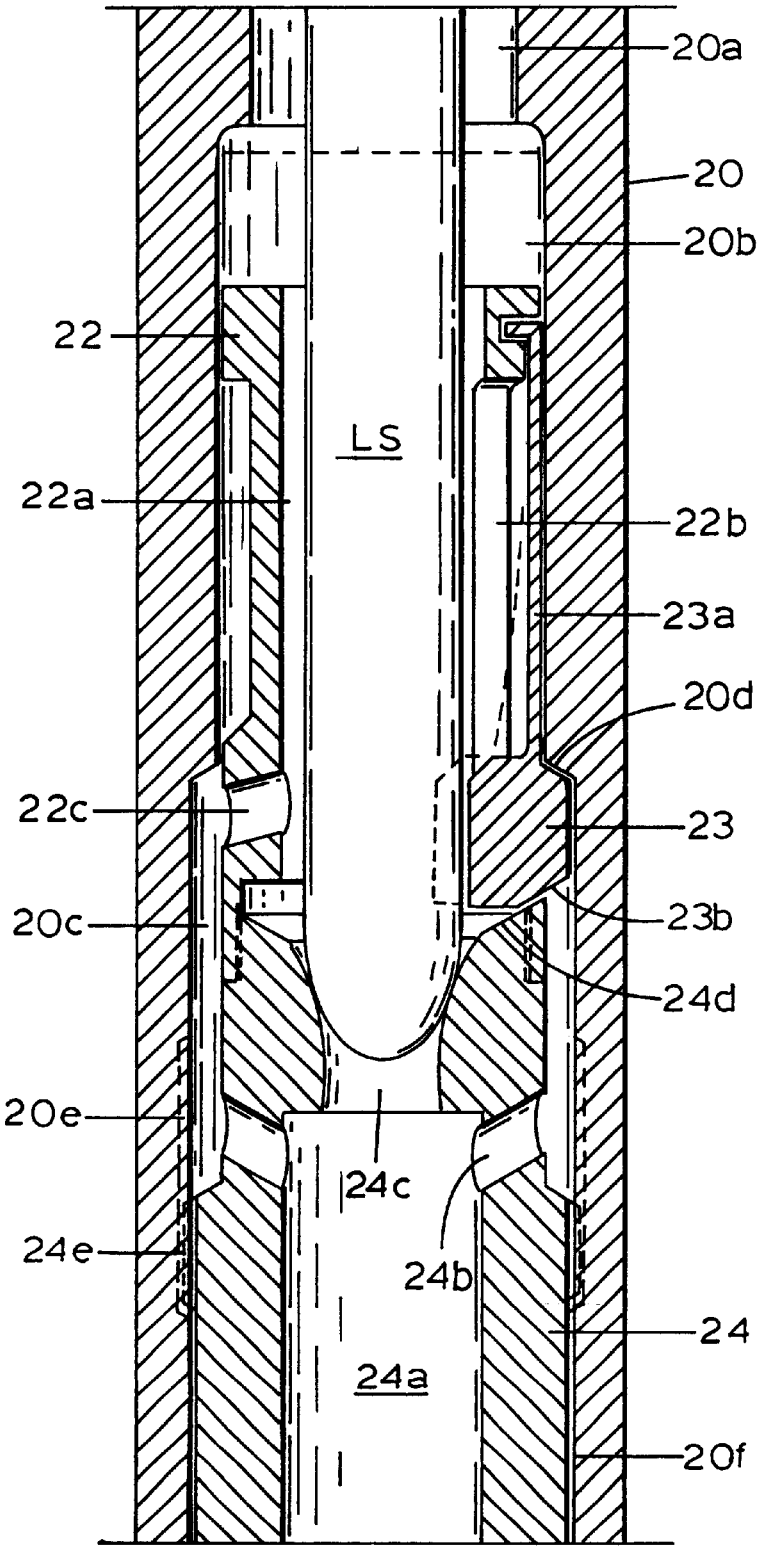
FIG. 4 is a side elevation of a portion of an alternate embodiment, mostly cut away, of the apparatus that differs from the embodiment of FIG. 1.

FIG. 4 shows that portion that is changed to allow locking of the clutch by the use of a locking spear LS dropped down the drill string bore. Clutch element 24 is rotationally secured to body 20 by mating splines 20*e* and 24*e*. Below clutch element 24 the apparatus is functionally as shown by FIG. 1. Lock carrier extension 22 is threadedly connected to the clutch element 24. Body 20 is shown as one piece, omitting threaded connections, with annulus 20*c* for fluid flow and for lock shoulder 20*d*, provided by bore 20*f*.

Clutch element 24 is in the normal drilling position with the clutch engaged. If the clutch is to disengage (no spear LS present) clutch element 24 rises, lock elements 23 are cammed inwardly in window 22*b* (note dashed lines) by sloped surfaces 24*d*, and holes 22*c* rise above the annulus 20*c*. Drilling fluid still flows through orifice 24*c* but the resistance to flow is changed to a degree detectable at the surface. There are preferably three peripherally distributed locks 23 supported by leaf springs 23*a* which are secured to carrier 22. When a locking spear LS is dropped down the drill string bore to center up in orifice 24*c*, Lock elements 23 are trapped in the position shown. Axial forces holding the clutch down are transmitted between shoulder 20*d* and cam surface 24*d*. Leaf 23*a* does not need to carry locking forces. The drill string can forcefully rotate the bottom hole assembly in either direction. Drilling fluid can still flow through bores 20*a*, 20*b* and 22*a*, holes 22*c*, annulus 20*c*, holes 24*b* and out along bore 24*a*.

From the foregoing, it will be seen that this invention is one well adapted to attain all of the ends and objects hereinabove set forth, together with other advantages which are obvious and which are inherent to the tool.

It will be understood that certain features and subcombinations are of utility and may be employed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

What is claimed is:

1. A one-way drill string clutch apparatus, comprising:

a) a housing arranged to function as a length of drill string, having an upper and lower end, with means at each end of the housing for attachment to continuing drill string elements, at least one channel to conduct drilling fluid between portions of said drill string to be joined, and means for axial restraint and relative rotation between said upper and lower ends;

b) a one way clutch situated in said housing and arranged to engage said upper and lower ends for transmission of torque therebetween in one direction and for free rotation of one end relative to the other in the opposite direction; and c) means to urge said clutch toward engagement.

2. The apparatus of claim 1 wherein a drilling fluid flow resisting valve is situated in said housing and arranged to change the resistance to the flow of drilling fluid through said bore in response to the change between the engaged status and disengaged status of said clutch.

3. The apparatus of claim 1 wherein lock means is provided to be actuated in response to a signal from the surface to releasably lock the clutch such that it can transmit torque in both directions.

4. The apparatus of claim 3 wherein said signals comprises as a communication medium a recoverable spear dropped down the drill string bore.

5. The apparatus of claim 1 wherein said clutch is arranged to be engageable only when said ends are in one particular rotational relationship relative to each other.

6. A one-way drill string clutch apparatus, comprising:

a) a housing arranged to function as a length element of a drill string, with an upper and lower end, and means at each end of the housing for attachment to continuing elements of said drill string, said housing upper and lower ends bearingly related for axial restraint and relative rotation therebetween, means to conduct drilling fluid between drill string elements, when attached to said housing, and a generally central opening;

b) a first clutch engagement means on one of said ends;

c) a second clutch engagement means situated in said generally central opening, rotationally secured to the other said end, for limited axial movement therein, to move between a first position engaging said first clutch engagement means and a second position to disengage said first clutch engagement means, said first and second clutch engagement means arranged to conduct torque therethrough in one rotational direction only; and d) bias means situated in said housing and arranged to urge said two clutch engagement means into engagement.

7. The apparatus of claim 6 wherein a drilling fluid flow resisting valve is situated in said housing and arranged to change the resistance to the flow through said means to conduct drilling fluid in response to the change between the engaged status and disengaged status of said clutch.

8. The apparatus of claim 6 wherein lock means is provided to be actuated in response to a signal from the surface to releasably lock the clutch such that it can transmit torque in both directions.

9. The apparatus of claim 8 wherein said signals comprise, as a communication medium, a recoverable spear dropped down the drill string bore.

10. The apparatus of claim 6 wherein said first and second engagement means are arranged such that they can engage only when a particular relative rotational relationship exists between said ends.

11. A drill string one-way clutch apparatus comprising:

a) a housing arranged to function as a linear element of a drill string, having a first and a second portion, each portion having means at one end for attachment to continuing drill string elements, with a fluid channel to function as a continuation of the drill string bore, said two portions bearingly connected for relative rotation therebetween;

b) a splined opening in said first portion with a generally tubular clutch element situated therein with a splined exterior to engage said splined opening for axial movement, and an array of first clutch teeth on one end of said first portion;

c) mating second clutch teeth on said second portion to engage said first clutch teeth on said clutch element, arranged to conduct torque between said two portions in one rotational direction and to disengage in response to applied torque in the opposite direction;

c) bias means in said first portion arranged to bias said clutch element toward said second portion to engage said clutch teeth; and d) bearing means situated to connect said two portions for relative rotation, axial constraint, fluid tightness, and axial stiffness.

12. The apparatus of claim 11 wherein the teeth for said clutch have one dissimilar tooth and one mating dissimilar slot, said dissimilar tooth and dissimilar slot arranged such that said clutch can move axially to engage said clutch elements in only one rotational relationship between said two portions.

13. The apparatus of claim 12 wherein said dissimilar tooth is also axially longer than adjacent clutch teeth so that the dissimilar tooth rides over all opposing teeth to retain all other teeth axially out of engagement position until said dissimilar tooth enters said dissimilar slot.

14. The apparatus of claim 11 wherein a drilling fluid flow resisting valve is situated in said housing and arranged to change the resistance to the flow of drilling fluid through said fluid channel in response to the change between the engaged status and disengaged status of said clutch.

15. The apparatus of claim 11 wherein lock means is provided to be actuated in response to a signal from the surface to releasably lock the clutch such that it can transmit torque in both directions.

16. The apparatus of claim 15 wherein said signals comprise, as a communication medium, a recoverable spear dropped down the drill string bore.

* * * * *